US007152353B2

(12) United States Patent
Jurkovic

(10) Patent No.: US 7,152,353 B2
(45) Date of Patent: Dec. 26, 2006

(54) REFLECTIVE SIGN

(76) Inventor: Ivica J. Jurkovic, Miller, Canfield, Paddock and Stone P.L.C., c/o Robert Kelley Roth, 150 W. Jefferson Ave., Suite 2500, Detroit, MI (US) 48226

( * ) Notice: Subject to any disclaimer, the term of this patent is extended or adjusted under 35 U.S.C. 154(b) by 0 days.

(21) Appl. No.: 10/979,921

(22) Filed: Nov. 2, 2004

(65) Prior Publication Data

US 2006/0090385 A1 May 4, 2006

(51) Int. Cl.
*G09F 19/00* (2006.01)

(52) U.S. Cl. ..... 40/615; 40/616

(58) Field of Classification Search ..... 40/582, 40/671, 615, 616

See application file for complete search history.

(56) References Cited

U.S. PATENT DOCUMENTS

| | | | | | |
|---|---|---|---|---|---|
| 1,670,327 | A | * | 5/1928 | Tobener | 40/615 |
| 1,732,822 | A | * | 10/1929 | Wehr et al. | 40/615 |
| 2,004,635 | A | * | 6/1935 | Price | 40/615 |
| 2,062,094 | A | | 11/1936 | Kip | |
| 2,167,149 | A | | 7/1939 | Grote | |
| 2,193,057 | A | | 3/1940 | Carver | |
| 2,241,625 | A | * | 5/1941 | Tway | 40/615 |
| 2,359,131 | A | * | 9/1944 | Lytle | 40/615 |
| 2,379,741 | A | | 7/1945 | Palmquist | |
| 3,409,344 | A | | 11/1968 | Balint et al. | |
| 3,772,810 | A | | 11/1973 | Kupperman et al. | |
| 3,970,033 | A | | 7/1976 | Lindner et al. | |
| 4,443,510 | A | * | 4/1984 | Watt | 428/149 |
| 4,884,351 | A | | 12/1989 | Abramson | |
| 5,018,291 | A | * | 5/1991 | Pasquale et al. | 40/584 |
| 5,050,327 | A | | 9/1991 | Woltman | |
| 5,365,378 | A | | 11/1994 | Sorko-Ram | |
| 5,442,870 | A | | 8/1995 | Kochanowski | |
| 5,780,140 | A | * | 7/1998 | Nilsen | 428/172 |
| 6,029,382 | A | | 2/2000 | Kochanowski | |
| 6,128,842 | A | * | 10/2000 | Lotspeich et al. | 40/606.02 |
| 6,253,477 | B1 | | 7/2001 | Balint | |

* cited by examiner

*Primary Examiner*—Lesley D. Morris
(74) *Attorney, Agent, or Firm*—Miller, Canfield, Paddock and Stone; Robert K. Roth

(57) ABSTRACT

A reflective sign comprises a front face, an image formed by openings in the front face, a back face connected to the front face, and a reflective surface mounted on the back face behind the image, wherein light passing through the openings in the front face is reflected by the reflective surface back out through the openings.

8 Claims, 4 Drawing Sheets

REFLECTIVE SIGN

FIELD OF THE INVENTION

This invention relates to reflective signs and more particularly, to reflective signs suitable for use as yard signs.

BACKGROUND OF THE INVENTION

Signs, particularly yard signs, are used to convey information. One known example of a yard sign is a "beware of dog" sign, alerting visitors that an owner of a piece of property may have a dog on the premises. Such signs are often made of a single piece of metal, often painted with words. Such known signs tend to be relatively expensive, and may be aesthetically unappealing. Further, known signs, if painted, may fade when left outside for several years. It would be desirable to provide a lightweight, robust sign which is more readily visible at night and which is of an inexpensive, easy to assemble and modify construction.

SUMMARY OF THE INVENTION

In accordance with a first aspect, a reflective sign comprises a front face, an image formed by openings in the front face, a back face connected to the front face, and a reflective surface mounted on the back face behind the image, wherein light passing through the openings in the front face is reflected by the reflective surface back out through the openings.

Figure 1:
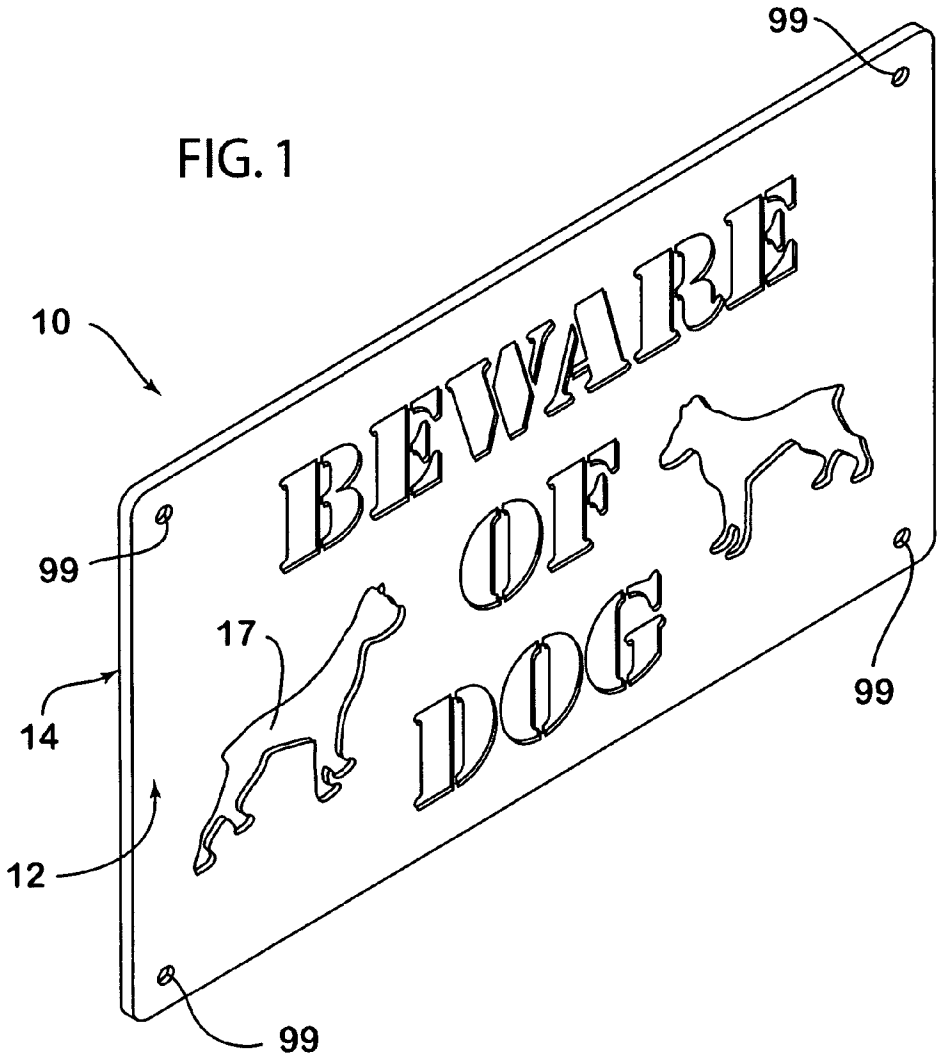
FIG. 1 is a perspective view of a reflective sign in accordance with a preferred embodiment.

It should be understood that the appended drawings are not necessarily to scale, presenting a somewhat simplified representation of various preferred features illustrative of the basic principles of the invention. The specific design features of the reflective sign as disclosed here, including, for example, specific dimensions of the images and words portrayed on the sign will be determined in part by the particular intended application and use environment. Certain features of the illustrated embodiments have been enlarged or distorted relative to others to increase visualization and clear understanding. In particular, thin features may be thickened, for example, for clarity of illustration. All references to direction and position, unless otherwise indicated, refer to the orientation of the invention as illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the reflective signs disclosed herein. The following detailed discussion of various alternative and preferred features and embodiments will illustrate the general principles of the invention with reference to an internal reformer suitable for use with a "beware of dog" sign. Other embodiments suitable for other applications will be apparent to those skilled in the art given the benefit of this disclosure.

Figure 2:
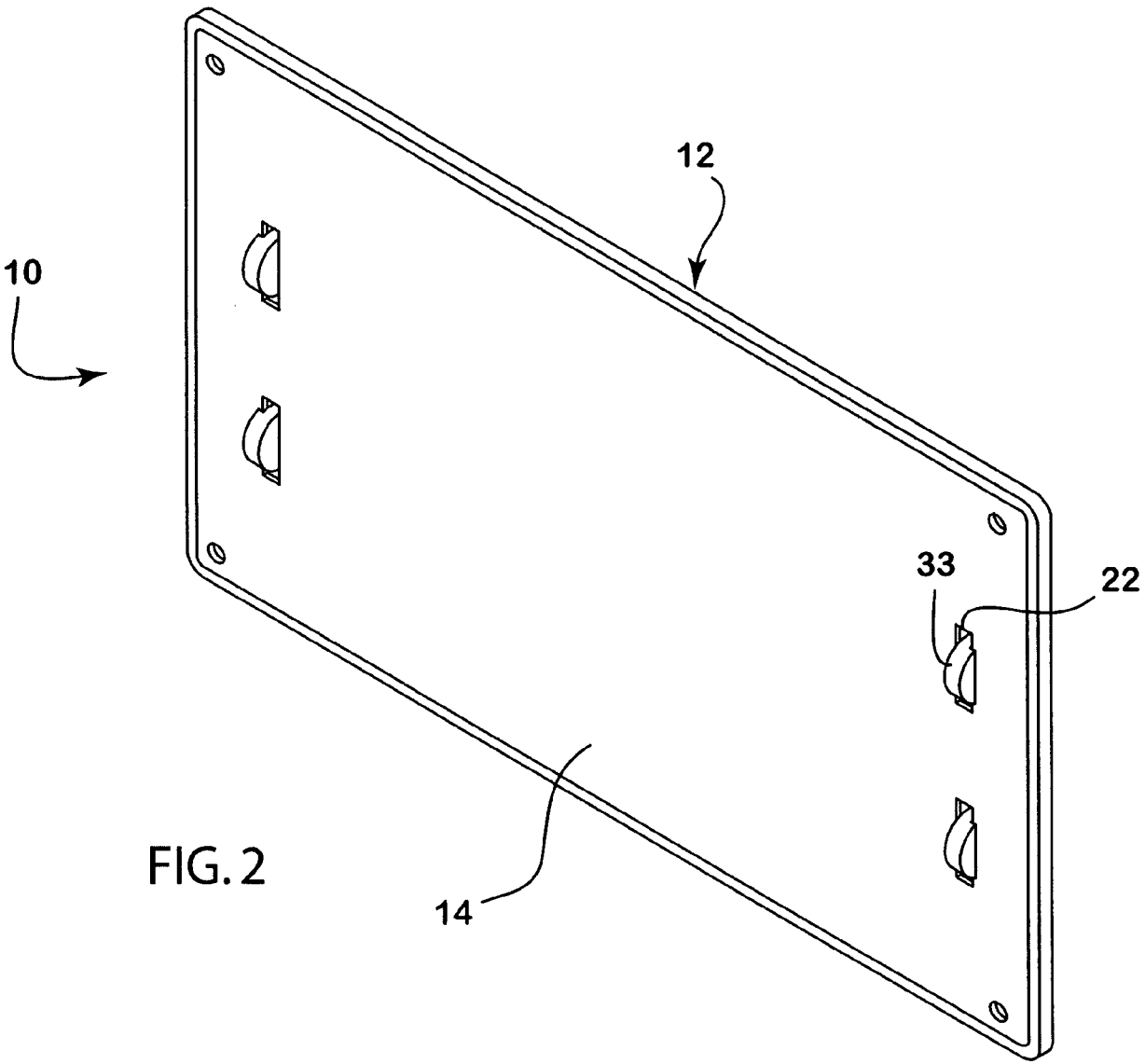
FIG. 2 is a back view of the reflective sign of FIG. 1.

FIG. 1 is a perspective view of a reflective sign 10 in accordance with a preferred embodiment. The sign is formed from a front face 12, a back face 14, and openings 17 formed in the front face 12 which allow the back face to be seen, forming an image. The image can be, as shown, either a rendition of an image such as a dog, or be formed as letters to spell out words or abbreviations, or both. Light is reflected by the reflective surface back out through the openings 17. In accordance with a highly advantageous feature, both of the faces 12, 14 may be made of a plastic such as polypropylene. Use of a plastic allows for a wide variety of aesthetically appealing color choices. Further, plastic is robust and resistant to the elements, and lends itself to highly advantageous assembly techniques. Preferably the front face and the back face are releasably connected by snap fit. As shown in FIG. 2, a series of openings 22 are provided in the back face 14. Each opening is adapted to receive a resiliently deformable tab 33 formed as a unitary extension of the front face 12. The front face can be connected to the back face by inserting the tabs 33 into the corresponding openings 22, having the tabs deform past the opening and snap back over the back face.

Figure 3:
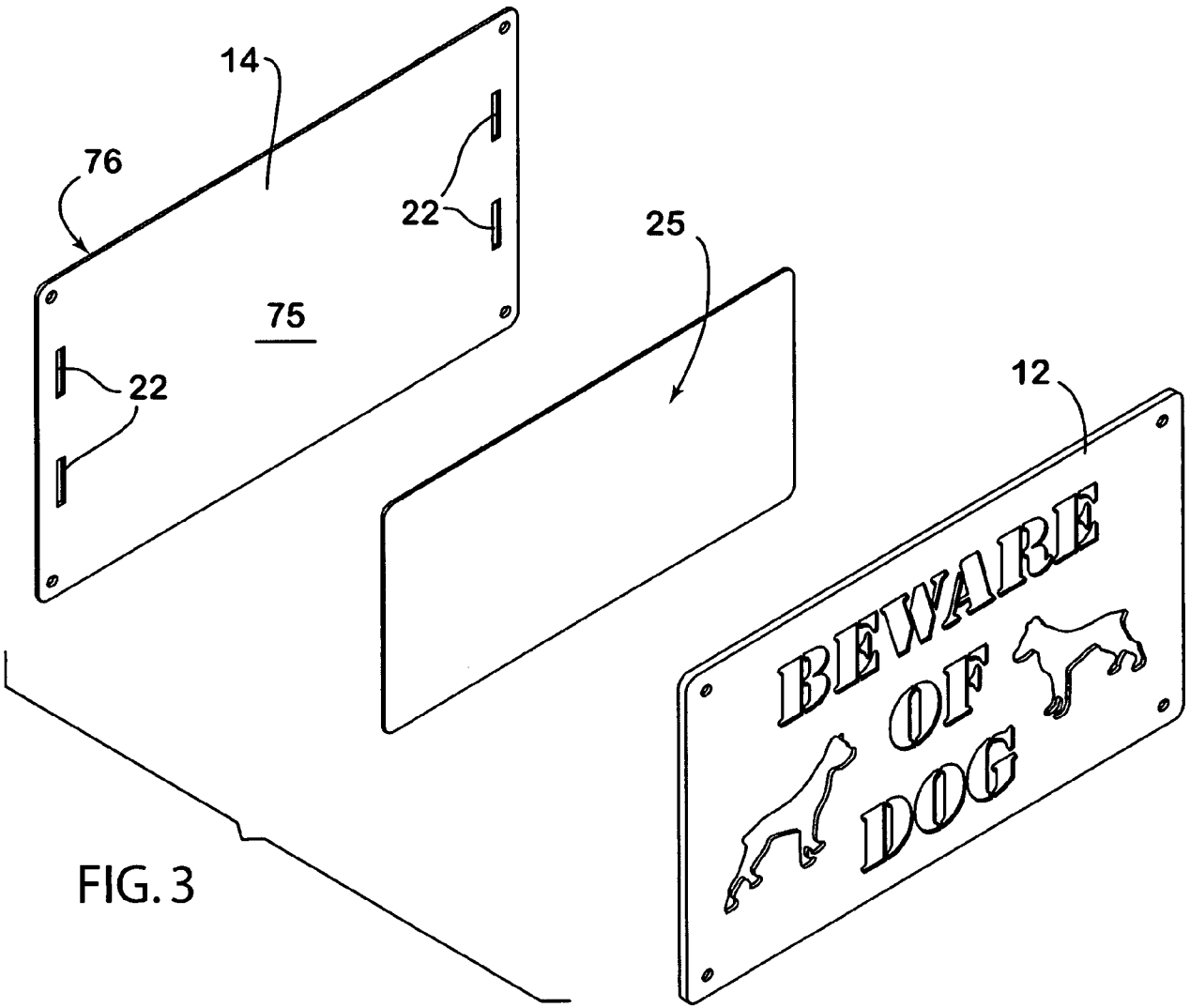
FIG. 3 is an exploded perspective view of the reflective sign of FIG. 1.
Figure 4:
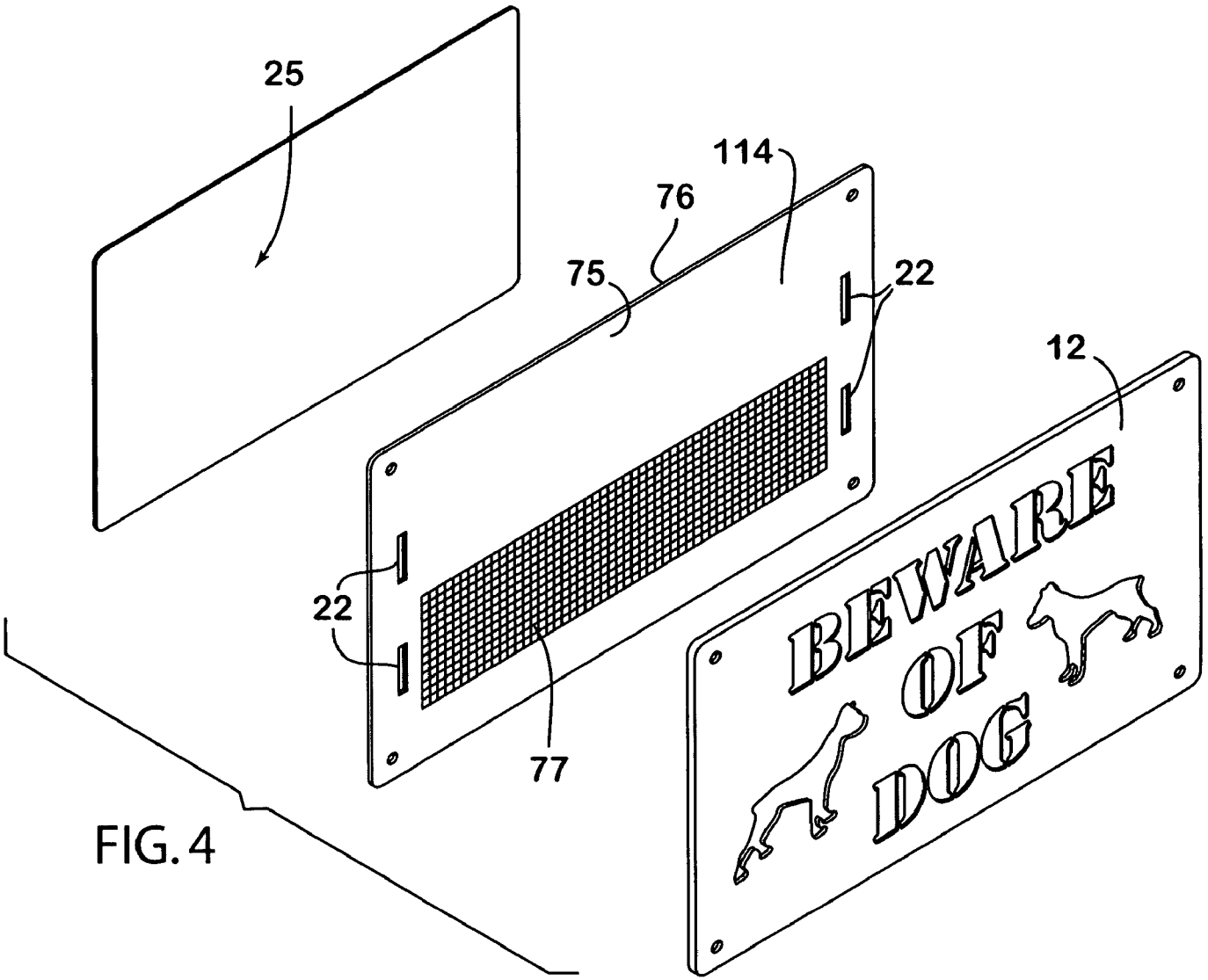
FIG. 4 is an exploded perspective view of an alternate preferred embodiment with retroreflective materials added.

Both the front face 12 and the back face 14 may be provided with openings 99, which can receive a fastener, allowing the sign to be attached to a wall, post, etc. In accordance with a highly advantageous feature, at least the portions of the back face 12 which are visible through the openings 17 are made of a reflective material, increasing visibility, especially at night when a light is shown on the sign 10. As shown in FIG. 3, the reflective material can comprise, for example, a reflective tape 25 applied to a front side 75 of the back face 14, so as to be visible through the openings 17. FIG. 4 shows an alternate preferred embodiment where the back face 114 is translucent or transparent, and a reflective tape 25 is applied to a back side 76 of the back face 114. In this preferred embodiment the back face may comprise, for example, transparent plastic such as polycarbonate or an acrylic. Alternatively, the back face may be not only translucent or transparent, it may also be retroreflective, as shown at 77.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A reflective sign comprising, in combination:

a front face;

an image formed by openings in the front face;

a back face, wherein the front face has at least one resiliently deformable tab, and the tab releasably engages the back face at a corresponding opening when the front face and the back face are connected; and a reflective surface mounted on the back face behind the image, the reflective surface comprising a reflective tape adhesively attached to a front side of the back face;

wherein light passing through the openings in the front face is reflected by the reflective surface back out through the openings.

2. The reflective sign of claim 1 wherein the front face and back face are each made of a plastic.

3. The reflective sign of claim 2 wherein the plastic is polypropylene.

4. The reflective sign of claim 2 wherein the back face plastic is translucent.

5. The reflective sign of claim 2 wherein the back face is retroreflective.

6. The reflective sign of claim 1 wherein the front face and the back face are provided with a plurality of openings, with each opening adapted to receive a corresponding fastener for attaching the reflective sign to a wall.

7. The reflective sign of claim 1 wherein reflective surface comprises a reflective tape adhesively attached to a back side of the back face.

8. The reflective sign of claim 1 wherein the image comprises letters.

* * * * *